US007325518B2

(12) United States Patent
Bering

(10) Patent No.: US 7,325,518 B2
(45) Date of Patent: Feb. 5, 2008

(54) VEHICLE PARALLEL COOLING SYSTEM

(75) Inventor: Christopher Adam Bering, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/221,602

(22) Filed: Sep. 8, 2005

(65) Prior Publication Data

US 2007/0051326 A1 Mar. 8, 2007

(51) Int. Cl.
*F02F 1/02* (2006.01)

(52) U.S. Cl. ..... 123/41.01; 123/41.71; 123/41.65

(58) Field of Classification Search ..... 123/41.01, 123/41.49, 41.7, 41.65; 165/51, 41, 122; 180/68.1, 68.4
See application file for complete search history.

(56) References Cited

U.S. PATENT DOCUMENTS 4,071,009 A * 1/1978 Kraina ..... 123/198 E
6,871,697 B2 * 3/2005 Albright et al. ..... 165/51
7,051,786 B2 * 5/2006 Vuk ..... 165/41

* cited by examiner

*Primary Examiner*—Stephen K. Cronin
*Assistant Examiner*—Hyder Ali

(57) ABSTRACT

A cooling system is provided for a vehicle having an engine. The cooling system includes a pair of heat exchangers, such as an oil cooler and a charge air cooler, laterally spaced apart from each other and located in front of a front end of the engine. A pair of blower units are in front of the coolers and blow cooling air rearwardly therethrough. A pair of duct units are located above the engine and to the rear of the coolers. Each duct unit includes a forward opening inlet receiving warmed air from the corresponding cooler, an upwardly opening outlet and a hollow housing extending from the inlet to the outlet. The outlets are spaced laterally apart from each other. A radiator is positioned above the duct unit housings and forward of the outlets. A set of radiator fans blow air upwardly through the radiator and are positioned between the radiator and the duct housings.

23 Claims, 5 Drawing Sheets

VEHICLE PARALLEL COOLING SYSTEM

BACKGROUND

The present invention relates to a cooling system for an engine powered non-rail off-road work vehicle such as an agricultural tractor.

In conventional vehicle cooling systems heat exchangers are arranged in series. This requires the air to pass through all the heat exchangers to meet an individual cooler's needs. This arrangement, which typically uses a mechanically driven fan to pull the air through the heat exchangers, also limits the area through which the air must pass. This is inefficient.

An advance vehicle cooling system, such as an agricultural tractor having an engine with a horizontally oriented rotation axis and a hood covering the engine is described in U.S. patent application Ser. No. 10/617,612 filed 11 Jul. 2003 and assigned to applicant's assignee. This cooling system includes an engine cooling radiator positioned above the engine and between the engine and the hood and a fan unit with electric motor-driven fans blowing air upwardly through the radiator. The fan unit is positioned above the engine and between the engine and the radiator. An engine charge air cooler is also positioned above the engine and between the engine and the hood, and a charge air cooler fan unit has electric motor-driven fans which blow air upwardly through the cooler. The hood has openings in its upper surface through which passes air blown by the radiator fan unit and the charge air cooler fan unit. This cooling system blows heated cooling air vertically upwardly, thus preventing the heated cooling air from being drawn back into the intakes of the cooling system and preventing heated air from being blown onto the exterior of the tractor cab.

However, in this system the air inlets and outlets are close enough together that they can compete for common air, thus causing control problems. Cooling air for the forward cooling components can flow over surfaces where it may be heated prior to entering the heat exchanger. Also, not all heated air is exhausted vertically, because the oil cooler and AC condenser are mounted behind the engine so that the heated air from these units is discharged laterally.

Vehicle cooling systems must be increasingly flexible and efficient while remaining cost competitive. Such systems should reduce recirculation, reduce fan power consumption, reduce or eliminate mechanical ties to the engine, and provide improved control capability.

SUMMARY

Accordingly, an object of this invention is to provide a vehicle cooling system wherein the air inlets and outlets do not compete for common air.

A further object of the invention is to provide such a cooling system wherein cooling air for front heat exchangers cannot flow over surfaces where it may be heated prior to entering the heat exchangers.

A further object of the invention is to provide such a cooling system wherein all heated air is exhausted vertically.

A further object of the invention is to provide such a cooling system with cooling air blowers which are not mechanically driven by the engine.

These and other objects are achieved by the present invention, wherein a cooling system is provided for a vehicle having an engine. The cooling system includes a pair of heat exchangers, such as an oil cooler and a charge air cooler, laterally spaced apart of each other and located in front of the engine. A pair of blower units are in front of the coolers and blow cooling air rearwardly through the coolers. A pair of duct units are arranged to the rear of the coolers, with inlets and a substantial portion of the duct bodies in front of the engine, and with outlets above the engine. Each duct unit includes a forward opening inlet receiving warmed air from the corresponding cooler, an upwardly opening outlet and a hollow housing extending from the inlet to the outlet. The outlets are spaced laterally apart from each other. A radiator is positioned above the duct unit housings and forward of the outlets. A set of radiator fans blow air upwardly through the radiator and are positioned between the radiator and the duct housings. The blowers and fans are driven by electric motors. Because the cooling air blowers are not mechanically driven by the engine, there is additional flexibility to arrange the heat exchangers in such a way as to effectively increase the area through which the cooling air passes. This reduces the velocity of the air and the power necessary to move it.

By allowing each system to draw from a separate air space and exhaust to a separate air space, recirculation and coupling between different cooling subsystems is reduced or prevented. Cooling air for the forward cooling components is not allowed to flow over surfaces where it may be heated prior to entering the heat exchanger, and all heated air is exhausted vertically. Such a system reduces fan power consumption, mechanical ties to the engine, and provides improved control capability.

DETAILED DESCRIPTION

Figure 1:
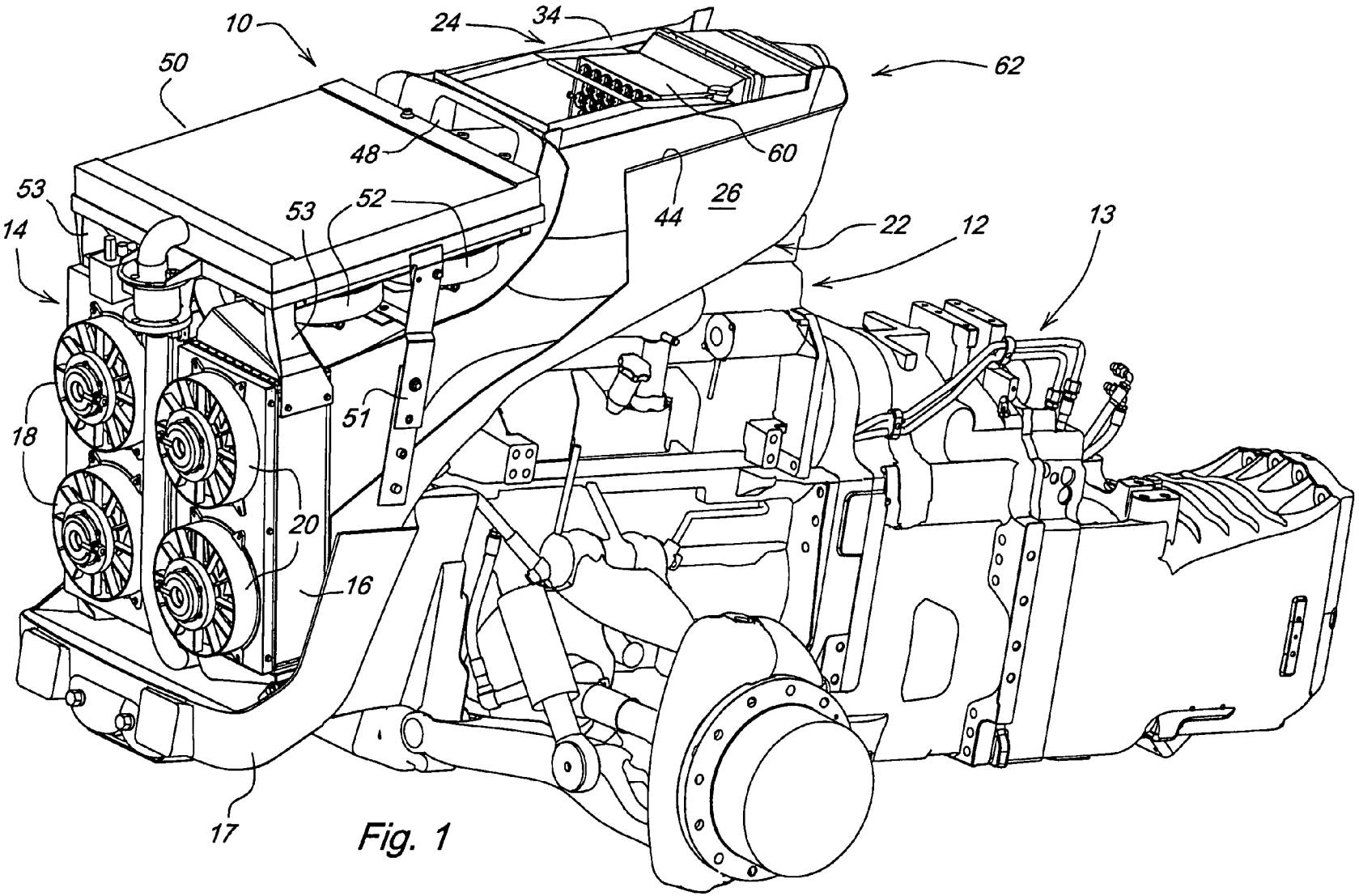
FIG. 1 is a perspective partially cut-away view of a vehicle cooling system component arrangement according to the present invention.
Figure 2:
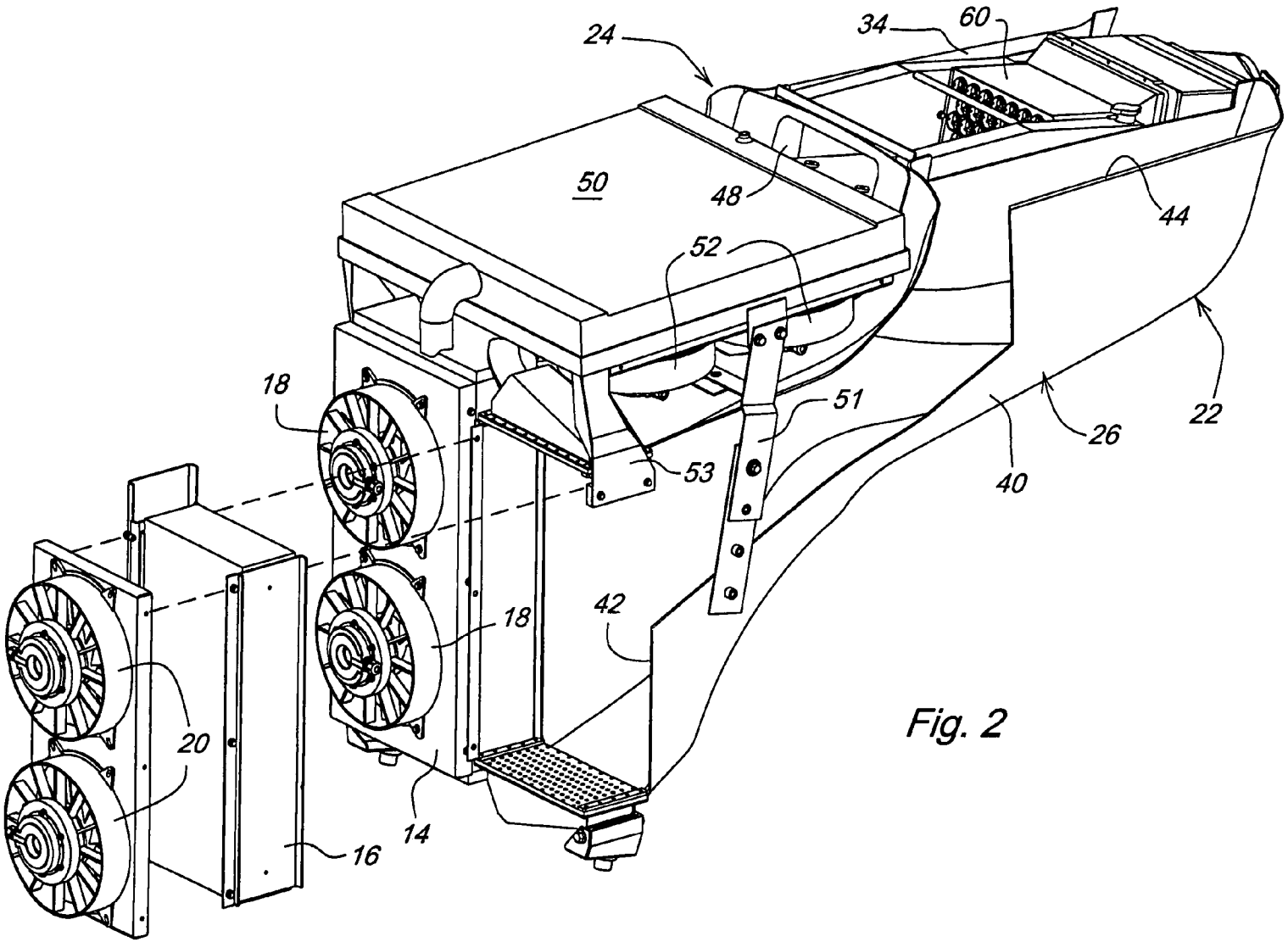
FIG. 2 is a perspective partially cut-away partially exploded view of a vehicle cooling system component arrangement according to the present invention.
Figure 3:
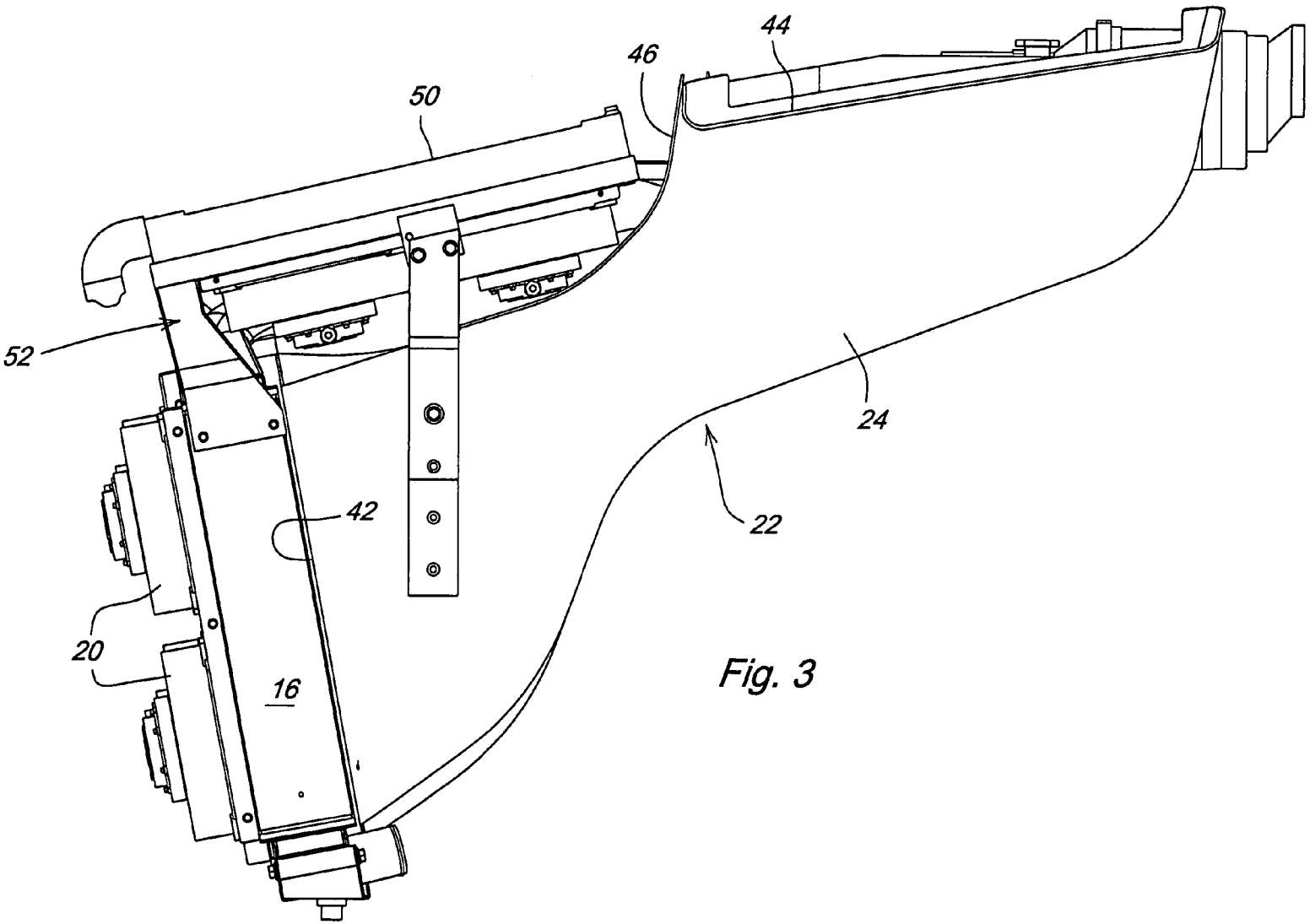
FIG. 3 is a side view of the vehicle cooling system of FIG. 1.

Referring the FIGS. 1, 2 and 3, a cooling system 10 is provided for a vehicle (not shown) having a front oriented engine 12. The cooling system 10 includes a pair of heat exchangers for cooling vehicle subsystems, such as an oil cooler 14 and a charge air cooler 16. Coolers 14 and 16 are spaced laterally apart from each other and are mounted in front of the engine 12, and are supported by a "chin" casting 17 which is bolted to a front portion of the tractor chassis elements, which include the engine 12 and the transmission 13.

A first pair of electric motor driven air moving units 18 blow cooling air rearwardly through cooler 14. A second pair of electric motor driven air moving units 20 blows cooling air rearwardly through cooler 16. Air moving units 18 and 20 are positioned in front of the coolers 14 and 16, respectively. The air moving units 18 and 20 may be blowers, fans or mixed flow units.

Figure 4:
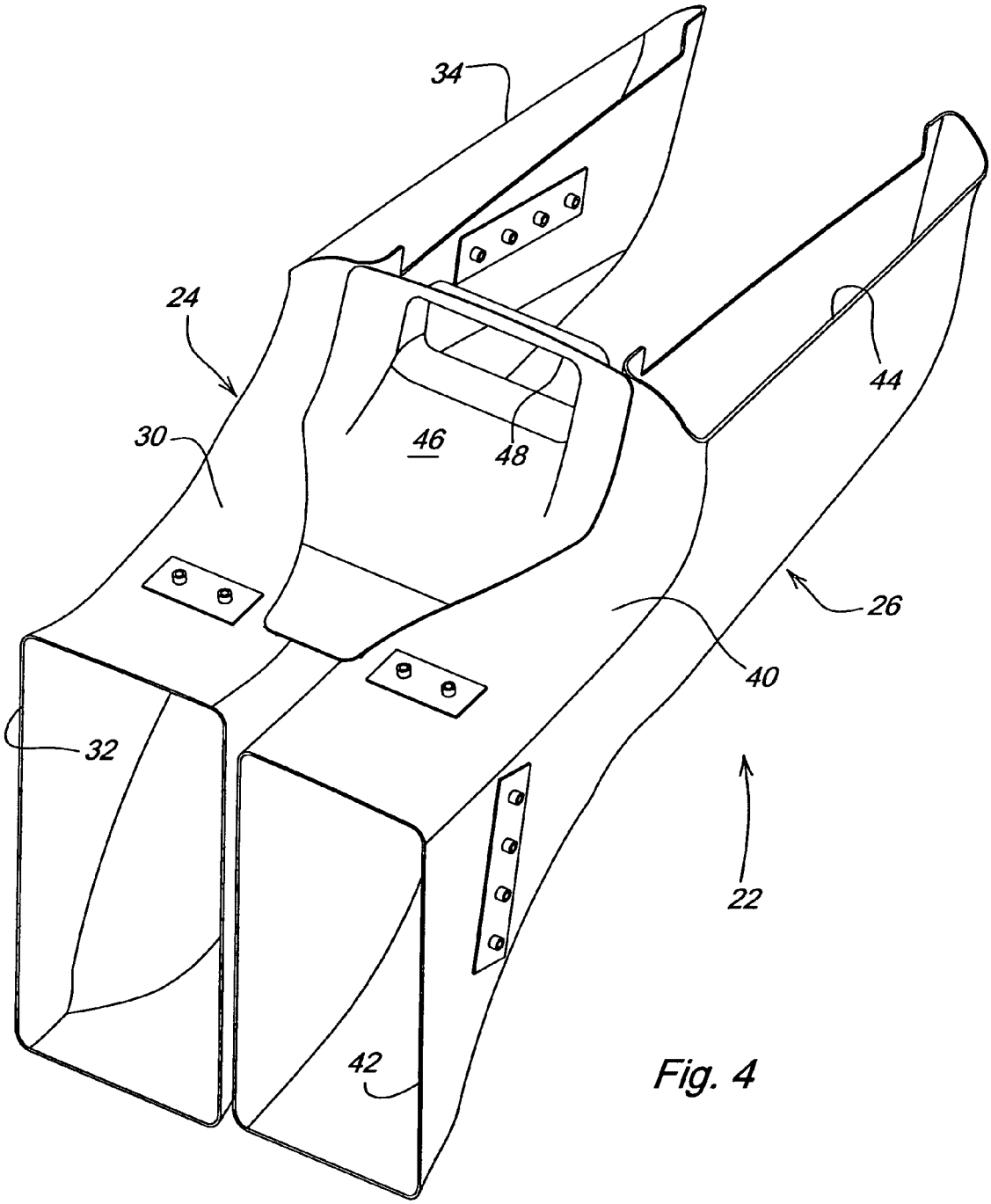
FIG. 4 is a perspective view of the duct portion of the assembly of FIG. 1.

The assembly or system 10 also includes a duct unit 22 which includes a pair of ducts 24 and 26. As best seen in FIG. 4, the duct 24 includes a hollow housing 30 which forms a forward facing front opening 32 and an upward facing rear outlet 34. Similarly, duct 26 includes a hollow housing 40 which forms a forward facing front opening 42 and an upward facing rear outlet 44. Ducts 24 and 26 are held together by a curved connecting plate 46 which engages and is fixed to an upper surfaces of ducts 24 and 26. An opening 48 extends in a fore-and-aft direction through a rear portion of plate 46. Inlets 32 and 42 are directly adjacent to each other, while outlets 34 and 44 are spaced apart laterally from each other. Preferably, the outlets 34 and 44 are substantially aligned with opposite sides of the engine 12.

A main engine heat exchanger or radiator 50, for cooling the engine 12, is positioned above and spaced apart from the front portions of ducts 24 and 26. The radiator 50 is positioned forward of the outlets 34 and 44. The outlets 34 and 44 have a vertical position which is higher than an upper surface of the engine 12.

Figure 5:
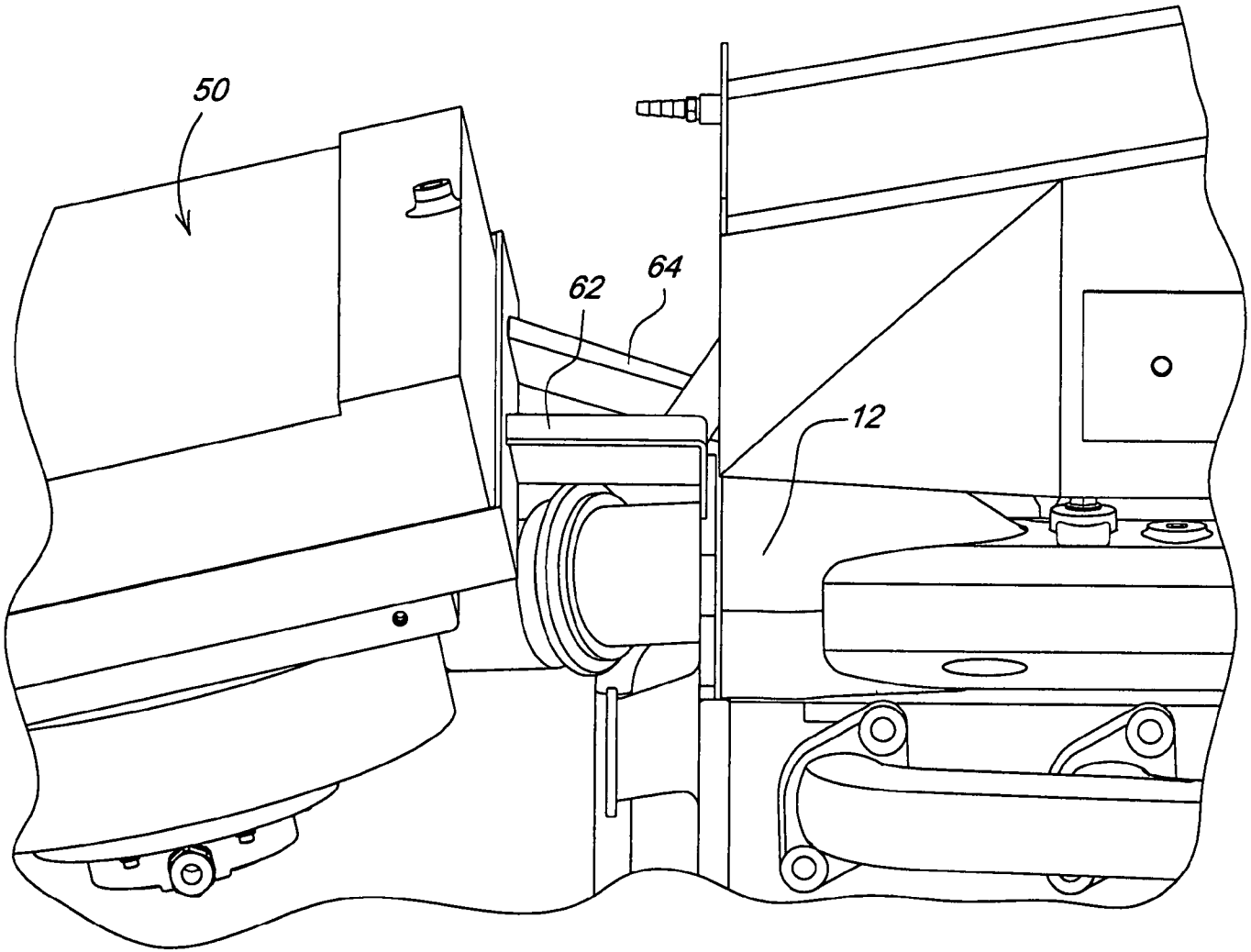
FIG. 5 is a detailed perspective view of a portion of the assembly of FIG. 1 with parts removed for clarity.

As best seen in FIG. 3, a front portion of radiator 50 is positioned above the coolers 14 and 16. A radiator air moving unit 52, preferably including a plurality of electric motor driven fans or blowers is positioned below radiator 50 and between the ducts 24, 26 and the radiator 50. The air moving unit 52 blows air upwardly through the radiator 50. Posts 53 support the front end of radiator 50 and units 52 with respect to the coolers 14 and 16. The rear end of radiator 50 is supported by a bracket 55, the rear end of which (not shown) is attached to a top portion of the engine 12. Straps 51 support the ducts 24 and 26 with respect to the radiator 50. As best seen in FIG. 5, a pair of support straps 62 and 64 extend from the rear end of radiator 50 to forward ends which are attached or bolted to a part the engine 12.

An engine air cleaner 60 is preferably located above the engine 12 and between the outlets 34 and 44. As a result, engine intake air can be drawn through opening 48 into air cleaner 60 and then into other engine air intake components (not shown). The elements described above are preferably covered by a conventional hood (not shown) with ports or openings aligned with the radiator 50 and with the outlets of ducts 24 and 26.

In operation, heated cooling air from oil cooler 14 enters into inlet 32 of duct 24, flows through duct 24 and is discharged upwardly through outlet 34. Similarly, heated cooling air from charge air cooler 16 enters into inlet 42 of duct 26, flows through duct 26 and is discharged upwardly through outlet 44.

As a result, cooling air for the forward coolers 14 and 16 does not flow over any surfaces where it may be heated prior to entering the coolers 14 and 6. Also, all heated air is exhausted vertically from coolers 14, 16 and radiator 50. As a result, air from a separate region is drawn into each separate heat exchanger or cooler, and there is little interference or co-mingling between discharged heated air and cooling air being blown into the various coolers and heat exchangers.

With electric driven fans, instead of mechanical engine-driven fans, the fans and coolers can be optimally located so as to permit the incorporation of after treatment (exhaust) components required by future regulations, and so as to locate the heat exchanger close to the heat sources, which reduce plumbing losses and improves efficiency. Also with this system, cooling air can now be controlled and moved through each separate heat exchanger based on that unit's particular demand.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A cooling system for a vehicle having an engine, the cooling system comprising:

a first heat exchanger for cooling a first subsystem of the vehicle;

a second heat exchanger for cooling a second subsystem of the vehicle, said first and second heat exchangers being laterally spaced apart in front of a front end of the engine;

a first air moving unit for blowing air through the first heat exchanger;

a second air moving unit for blowing air through the second heat exchanger, the second air moving unit being spaced laterally apart from the first air moving unit;

a duct having a first forward opening inlet receiving warmed air from the first heat exchanger, a second forward opening inlet receiving warmed air from the second heat exchanger, a first housing extending from the first inlet to a first upwardly opening outlet, and a second housing extending from the second inlet to a second upwardly opening outlet, each outlet being located rearwardly of the corresponding inlet and above the engine.

2. The cooling system of claim 1, wherein:

the first outlet is spaced laterally apart from the second outlet.

3. The cooling system of claim 1, wherein:

the first and second outlet are substantially aligned with opposite sides of the engine.

4. The cooling system of claim 1, further comprising:

a radiator positioned above the first and second housings and forward of the first and second outlets.

5. The cooling system of claim 4, further comprising:

a radiator air moving unit for blowing air upwardly through the radiator.

6. The cooling system of claim 5, further comprising:

the radiator air moving unit is positioned between the radiator and the first and second housings.

7. The cooling system of claim 1, wherein:

the duct comprises first and second hollow duct units and a connecting plate which engages an upper portion of each duct unit.

8. The cooling system of claim 1, wherein:

the first and second inlets are positioned directly adjacent to each other, and the first and second outlets are space laterally apart from each other.

9. The cooling system of claim 1, wherein:

the first heat exchanger comprises an oil cooler; and the second heat exchanger comprises a charge air cooler.

10. The cooling system of claim 1, wherein:

an engine air cleaner is located between the first and second outlets.

11. A cooling system for a vehicle having an engine, the cooling system comprising:

a heat exchanger for cooling a vehicle subsystem, said heat exchanger being positioned forwardly with respect to the engine;

a subsystem air moving unit for moving air rearwardly through the heat exchanger; and a duct having a housing, the housing having an inlet receiving heated air from the heat exchanger and an outlet discharging the heated air upwardly.

12. The cooling system of claim 11, comprising:

a pair of heat exchangers, each for cooling a corresponding vehicle subsystem.

13. The cooling system of claim 11, wherein:

at least a portion of the housing is directly adjacent a portion of the engine.

14. The cooling system of claim 11, further comprising:

a radiator positioned forward of the outlet.

15. The cooling system of claim 14, further comprising:

a radiator air moving unit for moving air upwardly through the radiator.

16. The cooling system of claim 11, further comprising:

a radiator positioned above the housing and forward of the outlet.

17. The cooling system of claim 11, wherein:

the housing inlet opens in a forward direction and the housing outlet opens upwardly.

18. The cooling system of claim 11, further comprising:

the outlet has a vertical position which is higher than an upper surface of the engine.

19. A cooling system for a vehicle having an engine, the cooling system comprising:

a pair of heat exchangers, each for cooling a corresponding vehicle subsystem, said heat exchangers being Positioned forwardly with respect to the engine;

a pair of subsystem air moving units, each for moving air rearwardly through a corresponding one of the heat exchangers; and a pair of ducts, each duct having a first forward opening inlet receiving warmed air from a corresponding one of the heat exchangers, each duct having an upwardly opening outlet, and each duct having a housing extending from one of the inlets to one of the outlets.

20. The cooling system of claim 19, wherein:

the outlets are spaced laterally apart and positioned rearwardly with respect to the inlets.

21. A cooling system for a vehicle having an engine, the cooling system comprising:

a heat exchanger for cooling a vehicle subsystem, said heat exchanger being positioned forwardly with respect to the engine;

a subsystem air moving unit for moving air rearwardly through the heat exchanger;

a duct having a housing, the housing having an inlet receiving heated air from the heat exchanger and an outlet discharging the heated air upwardly; and a radiator positioned above the housing, above the heat exchanger and forward of the outlet.

22. A cooling system for a vehicle having an engine, the cooling system comprising:

a heat exchanger for cooling a vehicle subsystem, said heat exchanger being positioned forwardly with respect to the engine;

a subsystem air moving unit for moving air rearwardly through the heat exchanger;

a duct having a housing, the housing having an inlet receiving heated air from the heat exchanger and an outlet discharging the heated air upwardly;

a radiator; and a radiator air moving unit for moving air upwardly through the radiator, the subsystem air moving unit and the radiator air moving unit drawing air from separate regions.

23. A cooling system for a vehicle having an engine, the cooling system comprising:

a heat exchanger for cooling a vehicle subsystem, said heat exchanger being positioned forwardly with respect to the engine;

a subsystem air moving unit for moving air rearwardly through the heat exchanger; and a duct having a housing, the housing having an inlet end connected directly to a side of the heat exchanger and an outlet end discharging heated air upwardly, the housing extending continuously from the inlet end to the outlet end.

* * * * *